US007204300B2

(12) United States Patent
Kontu et al.

(10) Patent No.: US 7,204,300 B2
(45) Date of Patent: Apr. 17, 2007

(54) WELDED HEAT EXCHANGER WITH PLATE STRUCTURE

(75) Inventors: Mauri Kontu, Kalanti (FI); Juha Suominen, Uusikaupunkl (FI)

(73) Assignee: Vahterus Oy, Kalanti (FI)

( * ) Notice: Subject to any disclaimer, the term of this patent is extended or adjusted under 35 U.S.C. 154(b) by 450 days.

(21) Appl. No.: 10/492,024

(22) PCT Filed: Oct. 4, 2002

(86) PCT No.: PCT/FI02/00780

§ 371 (c)(1),
(2), (4) Date: Aug. 12, 2004

(87) PCT Pub. No.: WO03/031896

PCT Pub. Date: Apr. 17, 2003

(65) Prior Publication Data

US 2005/0011639 A1 Jan. 20, 2005

(30) Foreign Application Priority Data

Oct. 9, 2001 (FI) ..... 20011963

(51) Int. Cl.
*F28F 3/10* (2006.01)

(52) U.S. Cl. ..... 165/157; 165/167

(58) Field of Classification Search ..... 165/157, 165/166, 167
See application file for complete search history.

(56) References Cited

U.S. PATENT DOCUMENTS

| | | | | |
|---|---|---|---|---|
| 1,669,062 | A * | 5/1928 | Menzel | 165/167 |
| 4,287,945 | A | 9/1981 | Hessari | |
| 4,809,774 | A | 3/1989 | Hagemeister | |
| 4,815,534 | A | 3/1989 | Fuerschbach | |
| 5,832,736 | A * | 11/1998 | Yoshioka et al. | 62/225 |
| 6,158,238 | A | 12/2000 | Lampinen et al. | |
| 6,244,334 | B1 * | 6/2001 | Wu et al. | 165/166 |
| 6,318,456 | B1 * | 11/2001 | Brenner et al. | 165/167 |
| 6,510,894 | B1 * | 1/2003 | Watton et al. | 165/166 |
| 2003/0000688 | A1 * | 1/2003 | Mathur et al. | 165/167 |
| 2004/0031600 | A1 * | 2/2004 | Kontu | 165/167 |

FOREIGN PATENT DOCUMENTS

| | | |
|---|---|---|
| EP | 0203213 | 12/1986 |
| WO | WO 86/04405 | 7/1986 |
| WO | WO 91/09262 | 6/1991 |
| WO | WO 97/45689 | 12/1997 |
| WO | WO 99/30099 | 6/1999 |
| WO | WO 02/16852 | 2/2002 |

* cited by examiner

*Primary Examiner*—Allen J. Flanigan
(74) *Attorney, Agent, or Firm*—Nixon & Vanderhye, P.C.

(57) ABSTRACT

The invention relates to a heat exchanger (1) with plate structure, comprising a stack (6) of plates fitted inside a housing unit (2) assembled by welding circular heat transfer plates (10) and used as a pressure vessel. All the passages (7, 8, 26, 27) of the heat exchanger (1) are arranged to extend through an end plate (4). A flow guide (24) with the shape of the letter Z, or the like, is placed between the end plate (14) of the housing unit (2) and the end plate (14) of the stack (6) of plates.

6 Claims, 3 Drawing Sheets

B (1 : 2)

WELDED HEAT EXCHANGER WITH PLATE STRUCTURE

This application is the US national phase of international application PCT/FI02/00780 filed 4 Oct. 2002 which designated the U.S. and claims benefit of FI 20011963, dated 9 Oct. 2001, the entire content of which is hereby incorporated by reference.

The invention relates to a welded heat exchanger with plate structure for heat transfer between substances in the same state or in different states, such as gas or liquid. The heat transfer surfaces consist of heat transfer plates attached to each other and collected in a stack of plates which are circular in shape and which have at least two flow openings for the supply and discharge of a heat transfer medium through ducts formed by the plates. The plates of the heat exchanger are welded together in pairs at the outer perimeters of the flow openings, and the plate pairs are connected to each other by welding the plates of the plate pairs at their outer perimeters to the plates of other plate pairs. The stack of plates is fitted inside a cylindrical housing unit used as a pressure vessel. The invention relates to an arrangement, by means of which all the passages of the plate heat exchanger are placed in an end plate, and the stream of one heat transfer medium through the housing unit is guided to and from the desired ducts of the stack of plates in a desired direction.

A conventional plate heat exchanger is composed of superimposed plates which form a stack of plates which is clamped between two end plates by means of clamping screws. The ducts formed by the plates and the flow openings connected thereto are sealed at their outer perimeters by means of separate sealings. The plates of such plate heat exchangers are typically rectangular in shape, and the flow openings, usually four in number, are placed in the vicinity of the corners. In conventional plate heat exchangers, the streams of the heat transfer medium are normally arranged in such a way that the flow openings at opposite corners are used as inlet and outlet passages, wherein the streams of the primary and secondary sides flow in adjacent ducts formed by heat transfer plates. In conventional plate heat exchangers, it has been possible to step the streams of the primary and secondary sides and to divide them into several draughts by closing the flow openings at desired locations.

Conventional tubular heat exchangers, in which the second heat transfer medium streams in a bundle of tubes fitted inside a cylinder, normally apply plate-like flow guides which are perpendicular to the bundle of tubes. Thus, the stream of the heat transfer medium inside the cylinder, which normally belongs to the secondary side, will pass several times through the bundle of tubes. The number of flow guides can be used to accelerate the stream inside the cylinder and to induce turbulence in the stream, wherein the heat transfer properties can be improved. However, the dimensioning of tubular heat exchangers is normally based on the heat transfer inside the tubes, which is usually smaller than the heat transfer outside the bundle of tubes. The large size of the tubular heat exchangers is largely due to poor heat transfer inside the tube. The diameter of the cylinder of the tubular heat exchanger is normally small in relation to the length of the cylinder. The stream inside the cylinder is, in most cases, arranged to flow from one end to the other. Because of the shape of the heat exchanger, there are normally no sealing requirements set for the flow guides used as the support means for the bundle of tubes.

In heat exchangers composed of circular heat transfer plates, in which the stack of plates is placed inside a cylinder, it has been problematic to arrange the stream of the secondary side inside the cylinder in such a way that there is no by-pass flow. In heat exchanger structures of this kind, the stream flowing through the flow guides passes almost all the heat transfer surfaces, thereby substantially reducing the heat transfer properties. For this reason, flexible flow guides made of a metal sheet have been used in heat exchangers, to press rubber sealings or the like against the outer surface of the stack of plates and against the inner surface of the housing of the heat exchanger. The function of these flow guides is to prevent the transverse by-pass flow between the stack of plates and the housing. Thanks to their flexible structure, these flow guides have served well in operation. Nevertheless, the stiff spacer plates, which have been used to divide the stream of the secondary side into several draughts, have often proved to be leaky, even though they have been provided with rubber sealings against the stack of plates and the housing.

Finnish patent application 20001860 presents a solution for preventing by-pass flows of the secondary side. In this construction, the passages of the secondary side are fitted on the housing of the heat exchanger, which is an expensive and bulky solution.

It is an aim of the present invention to provide a welded heat exchanger made of circular heat transfer plates, which has the good pressure resistance properties of the tubular heat exchanger and whose heat transfer properties correspond to those of a plate heat exchanger and whose all passages are fitted in an end plate in the same way as in the conventional plate heat exchanger.

The invention is based on the idea that a flow guide with the shape of the letter Z is fitted between the end plate of the stack of plates and the end plate of the heat exchanger, to guide the streams of the secondary side into flow passages located between the housing and the stack of plates and formed of thin plates curved against the housing.

More precisely, the heat exchanger with plate structure according to the invention is characterized in what will be presented in the characterizing part of claim 1.

Considerable advantages will be achieved with the welded heat exchanger with plate structure according to the invention. The streams of the primary and secondary sides can be divided in a desired manner, wherein the heat transfer conditions can be freely selected according to the properties of the heat transfer media and the flow quantities. The welded heat exchanger with plate structure can also be used as a concurrent, counter-current or cross-flow heat exchanger. In the heat exchanger with plate structure according to the invention, the heat transfer properties of the heat exchanger are not reduced by by-pass flows. All the passages of the welded heat exchanger with plate structure are fitted at the end plate of the heat exchanger, which facilitates the installation work and saves space.

In the following, the heat exchanger with plate structure according to the invention will be described in more detail with reference to the appended drawings, in which FIG. 1 shows schematically the welded heat exchanger with plate structure according to the invention in a side view.

Figure 1:
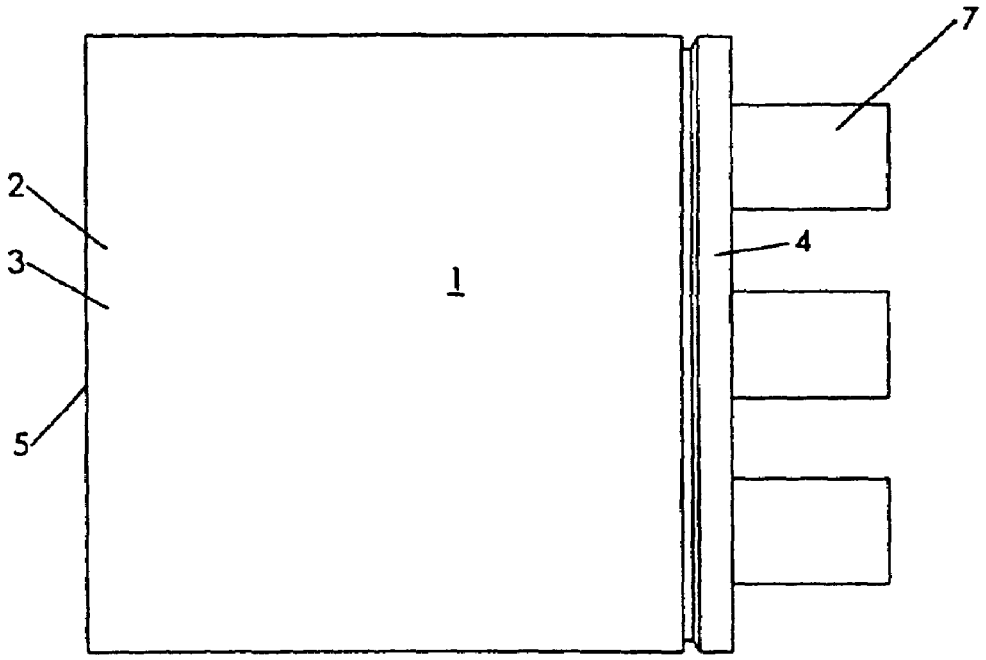
Figure 2:
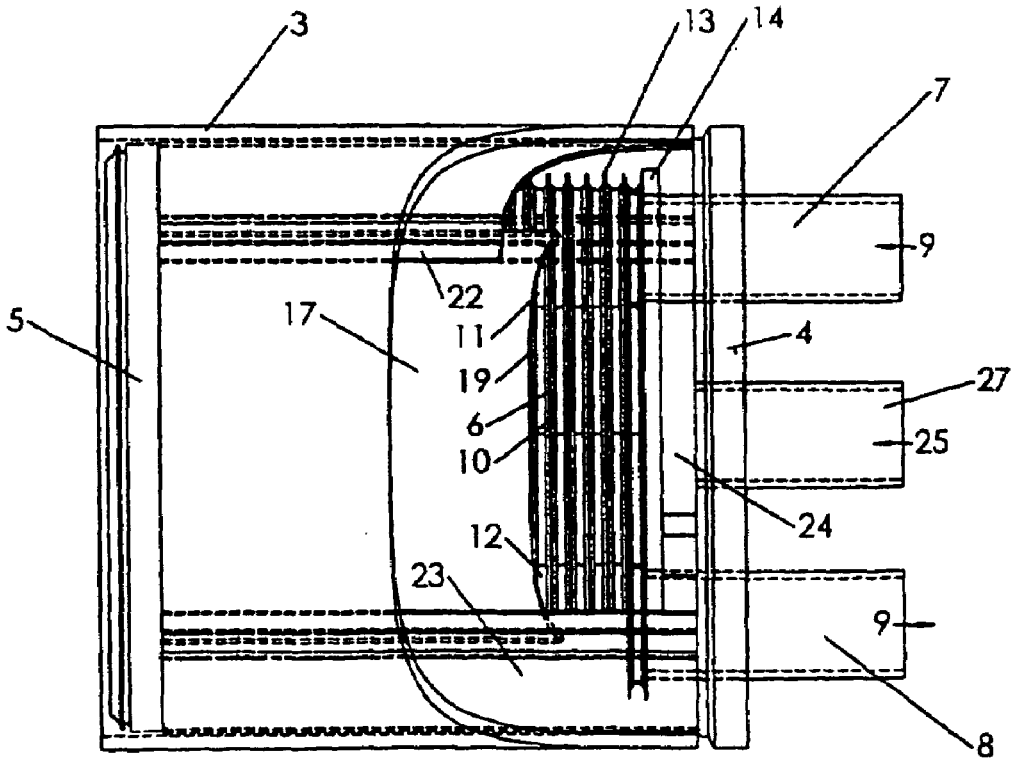
FIG. 2 shows schematically the welded heat exchanger with plate structure according to FIG. 1 in a partial cross-section seen from the side.
Figure 3:
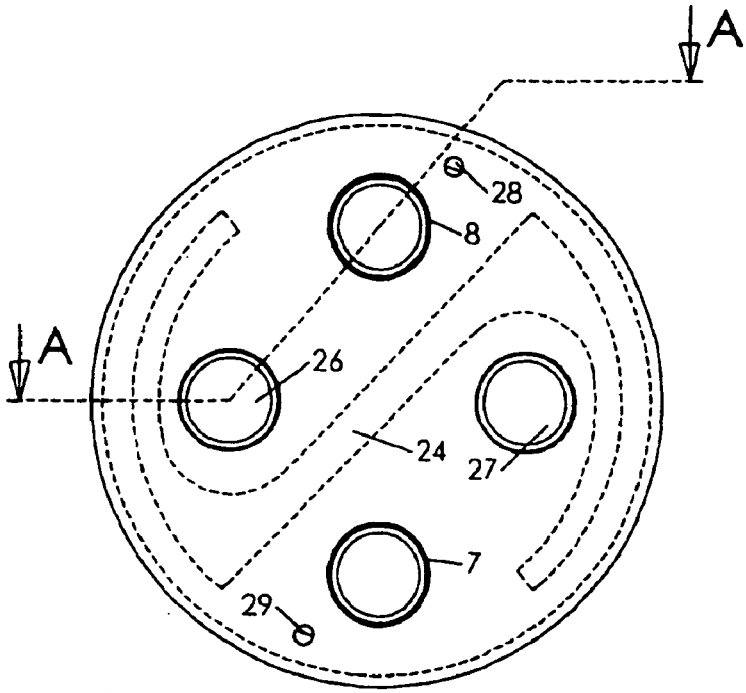
FIG. 3 shows schematically the heat exchanger with plate structure according to FIG. 1 in a top view.
Figure 4:
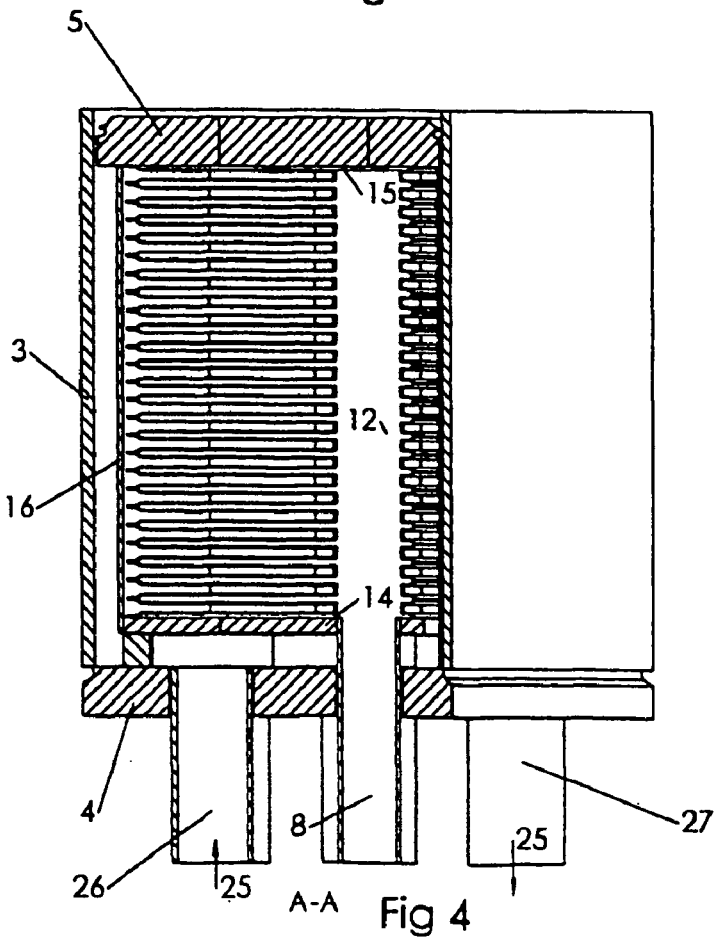
FIG. 4 shows schematically the welded heat exchanger with plate structure according to the invention in a cross-section along the line A—A.
Figure 6:
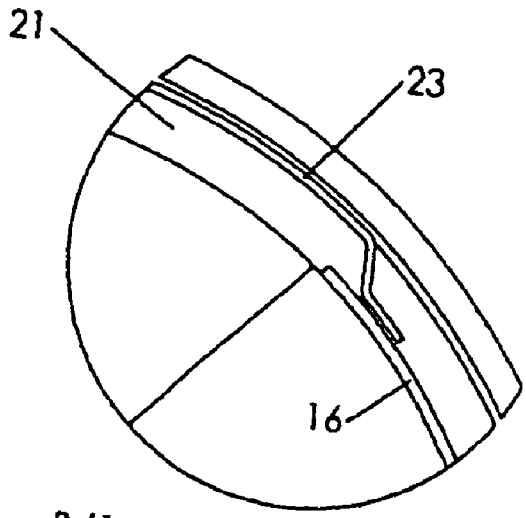
FIG. 6 shows schematically the structure of point B in an enlarged view.
Figure 5:
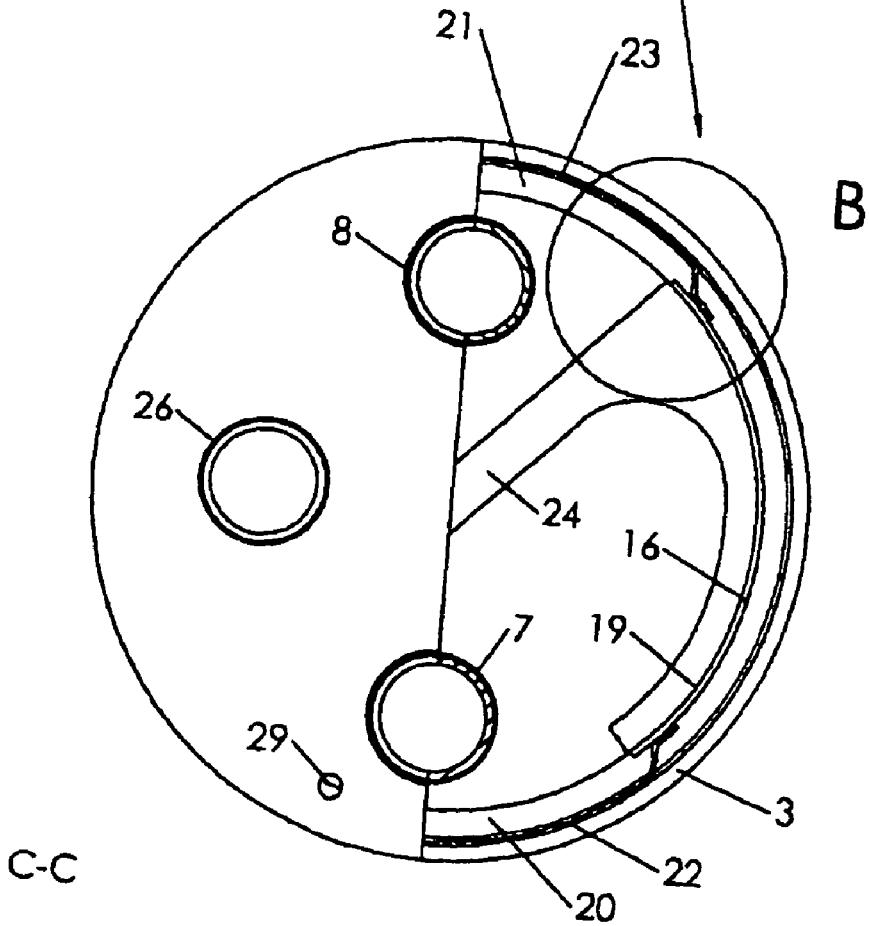
FIG. 5 shows schematically the welded heat exchanger with plate structure according to the invention in a partial cross-section seen from above.

In the following, the invention will be described in more detail with reference to the appended drawings. FIGS. 1 to 6 show an embodiment of a welded heat exchanger with plate structure according to the invention, in which all the passages are fitted in the end of the housing. The housing unit 2 used as a pressure vessel for the heat exchanger 1 with plate structure comprises a housing 3 and end plates 4 and 5 which are fixed to the housing 3 in a stationary manner. The housing unit 2 accommodates a stack 6 of plates forming the heat transfer surfaces, which stack can be removed for cleaning and maintenance, for example, by connecting one of the ends 4, 5 to the housing 3 by means of a flange joint. A heat transfer medium flowing inside the stack 6 of plates forms a primary stream which is led to the stack 6 of plates through the end plate 4 via an inlet passage 7 and is discharged via an outlet passage 8 in the end 4. The passage of the primary stream is illustrated with arrows 9.

The stack 6 of plates forms the heat exchange surfaces of the heat exchanger 1, which are composed of circular grooved heat transfer plates 10 connected to each other. The heat transfer plates 10 are connected together in pairs by welding at the outer perimeters of flow openings 11 and 12, and the pairs of plates are connected to each other by welding at the outer perimeters 13 of the heat transfer plates 10. The flow openings 11 and 12 constitute the inlet and outlet passages of the primary stream inside the stack 6 of plates, through which passages the heat transfer medium is led and discharged from the ducts formed by the heat transfer plates.

The stack 6 of plates is assembled and pre-tightened by welding the end plates 14, 15 in the stack 6 of plates together with side support plates 16, 17. To avoid a by-pass flow of the heat transfer medium in the space between the stack 6 of plates and the side support plates 16, 17, the space is provided with rubber sealings 18, 19 or the like before the assembly. The plates 22, 23 of the flow passages 20, 21 between the housing 3 and the stack 6 of plates are welded together with the side support plates 16, 17. The plates 22 and 23 are curved against the housing 3, and their edges are used as springs to press the side support plates 16, 17 and the rubber sealings 18, 19 against the stack 6 of plates.

A flow guide 24 with the shape of the letter Z is fitted between the end plate 3 of the housing unit 2 and the end plate 14 of the stack 6 of plates to divide the space between the end plates 4, 14 in two parts and to guide the streams to a passage 20 and the discharge from a passage 21. The inlet and outlet passages 26, 27 of the secondary stream, which is shown by arrows 25, are connected to the end plate 4 of the housing unit 2. For emptying and aeration of the heat exchanger, the end plate 4 of the housing unit 2 is provided with aeration and emptying screws 28, 29.

The heat exchanger 1 with plate structure, according to the invention, is normally used by adjusting and controlling the streams of the primary and secondary side. The only restriction for the use of the apparatus is the first starting up, when one should take into account that the plates 22, 23 of the flow passages 20, 21 are not parts of a pressure vessel and that a given delay time should be allowed for the flow passages 20, 21 and the spaces adjacent to them to be filled with the heat transfer medium. When turning on the heat exchanger 1, aeration must-be performed via the screws 28, 29. In a corresponding manner, the heat exchanger 1 can be emptied via the screws 28, 29, depending on the position of the assembly.

It will be obvious for a person skilled in the art that only one embodiment of the inventive idea has been described above, and it may naturally vary within the scope of protection presented in the claims. For example, the external shape of the flow guide 24 in the welded heat exchanger 1 with plate structure, having the shape of the letter Z, may vary freely as long as the space is divided in two parts by the piece, to prevent by-pass flows. Furthermore, the spaces inside the housing 3 and the side support plates 16, 17 can be filled with the heat transfer medium in another way than that presented above.

The invention claimed is:

1. A welded heat exchanger (1) with plate structure, intended for heat transfer between substances in the same state or in different states, such as a gas or a liquid, comprising a closed stack (6) of plates consisting of circular heat transfer plates (10) used as heat transfer surfaces and connected to each other at their outer perimeters (13) or at the outer perimeters of their flow openings (11, 12), one heat transfer medium flowing inside said stack (6), a housing unit (2) used as a pressure vessel and consisting of ends (4, 5) supporting the stack (6) of plates and the surrounding housing (3), another heat transfer medium flowing inside said housing unit (2), and inlet and outlet passages (7, 8, 27, 28) for the heat transfer media flowing in the stack (6) of plates and in the housing unit (2), extending through the end (4), characterized in that the inlet and outlet passages (26, 27) of the heat transfer medium flowing in the housing unit (2) are connected to the end plate (4) of the housing unit (2), and that the inlet and outlet passages (7, 8) of the stack (6) of plates are connected to the stack (6) of plates and the end plate (4), that a flow guide (24) with the shape of the letter Z or a corresponding shape is fitted between the end plate (4) of the housing unit (2) and the stack (6) of plates, to guide the stream to a flow passage (20) between the housing (3) and the stack (6) of plates and to discharge it from a flow passage (21), and that the flow passages between the housing (3) and the stack (6) of plates consist of thin plates (22, 23) curved against the housing (3) and attached at their sides to side support plates (16, 17) of the stack (6) of plates.

2. The welded heat exchanger (1) with plate structure according to claim 1, characterized in that rubber sealings (18, 19) are provided under the side support plates (16, 17) of the stack (6) of plates, to prevent by-pass flows.

3. The heat exchanger (1) with plate structure according to claim 1, characterized in that the sides of the plates (22, 23) of the flow passages (20, 21) between the housing (3) and the stack (6) of plates are bent so that they are used as springs to press the rubber sealings (18, 19) against the stack (6) of plates.

4. The heat exchanger (1) according to claim 1, characterized in that the flow guide (24) with the shape of the letter Z, fitted between the end plates (4, 5) of the housing unit (2), and the plates (22, 23) of the flow passages (20, 21) between the housing (3) and the stack (6) of plates, are elements which do not belong to the pressure vessel.

5. The heat exchanger (1) with plate structure according to claim 1, characterized in that the inner spaces between the end support plates (16, 17) of the stack (6) of plates and the housing (3) of the housing unit (2) are filled with a non-fluid heat transfer medium.

6. The heat exchanger (1) with plate structure according to claim 1, characterized in that the plates (22, 23) forming the flow passages (20, 21) between the housing (3) and the stack (6) of plates are provided with at least one opening to guide heat transfer medium into the inner spaces between the housing (3) and the side support plates (16, 17) of the stack (6) of plates.

* * * * *